US007910168B2

(12) United States Patent
Huang

(10) Patent No.: US 7,910,168 B2
(45) Date of Patent: Mar. 22, 2011

(54) METHOD FOR FORMING A FILM ON A SUBSTRATE

(75) Inventor: Chih-Hao Huang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 373 days.

(21) Appl. No.: 12/125,807

(22) Filed: May 22, 2008

(65) Prior Publication Data

US 2009/0291218 A1 Nov. 26, 2009

(51) Int. Cl.
*B05D 3/00* (2006.01)

(52) U.S. Cl. ..... 427/384; 427/385.5; 427/387

(58) Field of Classification Search ..... None
See application file for complete search history.

(56) References Cited

U.S. PATENT DOCUMENTS

2004/0201014 A1* 10/2004 Yagihashi et al. ..... 257/40
2007/0196427 A1* 8/2007 Jokinen et al. ..... 424/426

OTHER PUBLICATIONS

Fardad et al, Journal of Non-Crystalline Solids, 183, pp. 260-267, 1995.*
Raman et al, Journal of Membrane Science, 105, pp. 273-279, 1995.*
Cao et al, Advanced Materials, 8(7), pp. 588-591, 1996.*

* cited by examiner

*Primary Examiner* — Erma Cameron
(74) *Attorney, Agent, or Firm* — WPAT, P.C.; Anthony King

(57) ABSTRACT

A method for forming a film on a substrate includes steps of: blending precursor, dissolvent, de-ionized water and catalyst in proportion to make sol solution; standing the sol solution for a period of to form gel solution; mixing the gel solution with diluent in proportion to form the coating solution; and coating the coating solution onto the substrate and then drying the coating solution to form a film on the substrate. The ratio of the gel solution and the diluent in the coating solution can be controlled to change the thickness of the film formed on the substrate. The ratio of the gel solution and the diluent is adjusted, the thickness of the film is adjusted according to the ratio to realize controlling the thickness of the film, therefore, the method for forming the film on the substrate is simply, and the thickness of the film can be controlled exactly, so the method can be used in industry field.

10 Claims, 1 Drawing Sheet

METHOD FOR FORMING A FILM ON A SUBSTRATE

BACKGROUND OF THE INVENTION

1. Field of the Invention

This present invention relates to a method for forming a film, and more specifically to a method for forming a film on a substrate, the method can control a thickness of the film formed on the substrate.

2. The Related Art

Sol-Gel method is used to form $SiO_2$ film, $TiO_2$ film, $ZrO_2$ film, etc. The film formed by the Sol-Gel method has a good chemical uniformity, an easy forming process and a lower cost, and suits to coat various substrate, so the film formed by the Sol-Gel method is used widely. Metal alkane oxide (precursor), dissolvent, deionized water and catalyst are blended to form sol solution, then the sol solution undergoes hydrolyzing, condensing and polymerizing to form gel solution slowly, the gel solution is coated on a substrate to form a film.

Nevertheless, the ratio of the metal alkane oxide, the dissolvent, the deionized water and the catalyst, the forming condition and the environment factor can effect the thickness of the film formed by the Sol-Gel method. Of course, when the film is made by the sol-gel method, the thickness of the film can be controlled by adjusting the ratio of the metal alkane oxide, the dissolvent, the deionized water and the catalyst. But, if the ratio of one of the metal alkane oxide, the dissolvent, the deionized water and the catalyst is adjusted, the entire ratio relation of the film will be changed, then the thickness of the film is not easy to be controlled. If the ratios of the metal alkane oxide, the dissolvent, the deionized water and the catalyst are adjusted at the same time, the thickness of the film can be controlled, but this operation is very complex.

SUMMARY OF THE INVENTION

An object of the invention is to provide a method for forming a film on a substrate including steps of: (1) blending precursor, dissolvent, de-ionized water and catalyst in proportion to form sol solution; (2) standing the sol solution for a period of time to form gel solution; (3) mixing the gel solution with diluent in proportion to form coating solution; and (4) coating the coating solution onto the substrate and then drying the coating solution to form a film on the substrate. The ratio of the gel solution and the diluent in the coating solution can be controlled to change the thickness of the film formed on the substrate.

As above description, a step about mixing the gel solution with the diluent is added in the tradition sol-gel method, the ratio of the gel solution and the diluent is adjusted, the thickness of the film is adjusted according to the ratio to realize controlling the thickness of the film, therefore, the method for forming a film on a substrate is simply, can proceed in the normal temperature, and the thickness of the film can be controlled exactly, so the method can be used in industry field.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
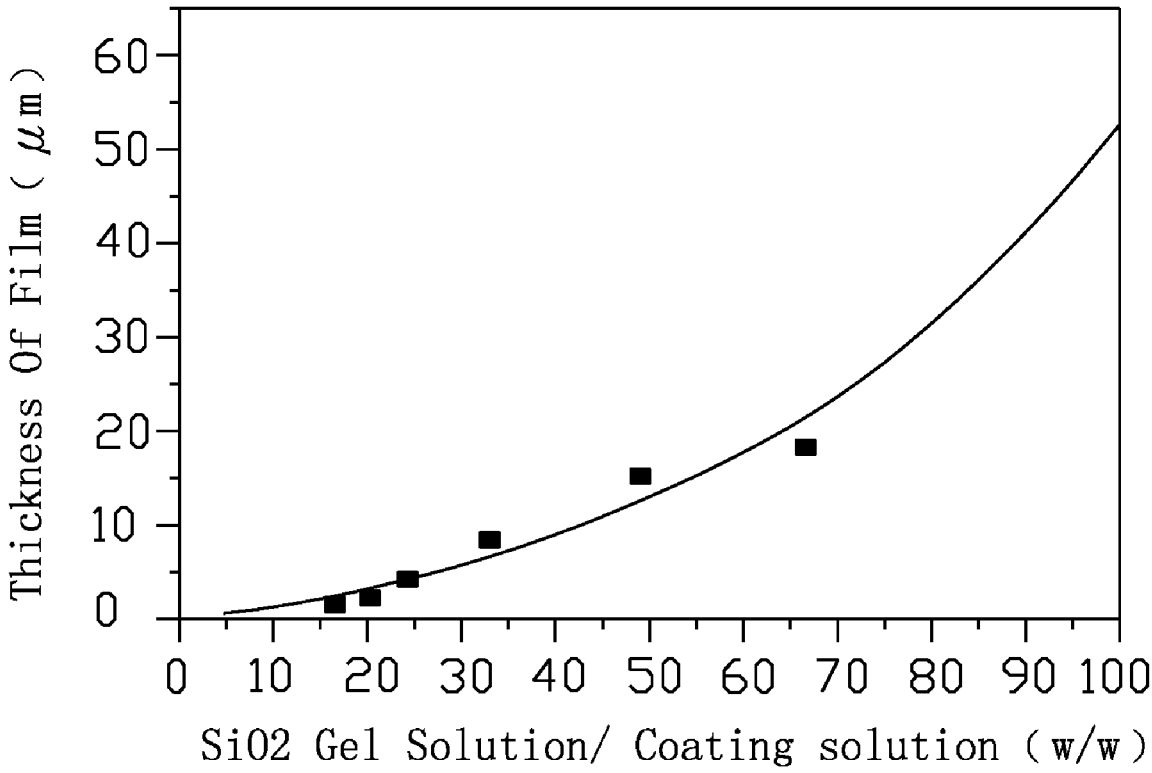
FIG. 1 is a schematic diagram showing a relation of a thickness of a film and a coating solution according to a method for forming a film on a substrate.

A method for forming a film on a substrate according to the invention is based on a sol-gel method. Firstly, blend precursor, dissolvent, de-ionized water and catalyst according to a certain proportion to make sol solution. The kinds and the ratios of the precursor, the dissolvent and the catalyst can be selected according to different demand. Different precursor means different film. In this embodiment, the method is used to form $SiO_2$ film, the precursor is a kind of silane compound which is expressed in a chemical formula: $R_nSiX_{4-n}$, wherein R means a kind of organic functional group, X means a hydrolytic functional group, n equals to zero, one or two.

The silane compound expressed in the above chemical formula is preferentially tetraethoxysilane, tetramethyl orthosilicate, methyl triethoxy silicane or ethyl triethoxy silicane.

The precursor can dissolve in alcohol, the dissolvent may be methanol, ethanol, isopropanol or other alcohol. The dissolvent is ethanol preferably.

The catalyst is acidic or alkaline. The acidic catalyst is HCl, $HNO_3$ or oxalic acid, etc. The alkaline catalyst is $NH_4OH$ or NaOH, etc. The acidic catalyst can accelerate hydrolyzing reaction and retard condensing reaction, particles formed in sol-gel are small when the acidic catalyst is used, then the film is flat and dense. The alkaline catalyst can retard hydrolyzing reaction and accelerate condensing reaction, particles formed in sol-gel are relatively big, and then the film is not flat. The choice of the catalyst bases on the kind of the precursor and the actual product, different catalyst means different effect. Generally, the catalyst is HCl solution.

In this embodiment, in order to make silicon dioxide film, the precursor is tetraethoxysilane, the dissolvent is ethanol, the catalyst is HCl solution. The ethanol, the de-ionized water and the HCl solution are added into a same container, then the tetraethoxysilane is added into the container, the weight ratio of the tetraethoxysilane, the ethanol, the de-ionized water and the HCl is 20:25:3:2. The silicon dioxide film formed according to the weight ratio has a good stability and a good adhesiveness, the thickness of the film is easy to be adjusted. The tetraethoxysilane, the ethanol, the de-ionized water and the HCl are mixed in normal temperature to form a mixture solution, the pH value of the mixture solution is 3.9-4.0 approximately to make the mixture solution react for about 2-4 hours. In the reaction process, a magnetic stirrer is used to agitate the mixture solution, a pH surveying instrument is used to test the pH value of the mixture solution to keep the pH value of the mixture solution in 3.9-4.0. After the reaction process the mixture solution becomes into a sol solution, the sol solution is stood for 12-24 hours to make the sol solution age, as a result, a gel solution is formed with a full hydrolyzation and polymerization.

The above-mentioned process mainly applies the sol-gel method. A step of mixing the sol solution with diluent is added in the present invention to adjust the thickness of the film exactly. For the gel solution being mainly alcohol-soluble, the diluent is methanol, ethanol, isopropanol or other alcohols. In this embodiment the dissolvent is ethanol. The gel solution and the diluent are mixed to form coating solution, and then the coat solution is coated onto a substrate, then the coating solution is dried by heating to form a film. The coating solution is coated in the substrate by spinning or dipping manner, the heating temperature is kept between 100-300° C.

The thickness of the film formed by the present invention is mainly controlled by the ratio of the gel solution in the coating solution, the more the ratio of the gel solution is, the thicker the film is. The thickness of the film and the ratio of the gel solution in coating solution mainly show a quadratic function relation. When the ratio of the gel solution is 100%, the thickness of the film is biggest. When the ratio of the gel solution is smaller, the thickness of the film is thinner, which does not mean that the ratio of the gel solution may near to zero. When the ratio of the gel solution is very small, the film will become uneven and uncontinuous.

Therefore, when the film is made, the ratio relation of the precursor, the dissolvent, the de-ionized water and the catalyst according to a certain proportion can be changed in a rational range. If the forming condition does not be changed, the thickness of the film will change along with the ratio of the gel solution in the coating solution according to a quadratic function parabola. Just a few groups of dispersive data between the ratio of the gel solution and the thickness of the film are ascertained, a relative diagram between the thickness of the film and the ratio of the gel solution in the coating solution as shown in FIG. 1. Under circumstance that the ratio relation of the precursor, dissolvent, de-ionized water and catalyst is invariable, different volumes of diluent are added to the gel solution according to the relative diagram for adjusting the concentration of the coating solution to make the different thickness film.

An unlimited embodiment is described as following. In a room temperature, firstly, mix 1000 g ethanol with 120 g de-ionized water and 80 g HCl solution with 25% concentration to form a mixture solution, and then measure the pH value of the mixture solution, the pH value of the mixture solution is 3.9-4.0 approximately. Next, add 800 g tetraethoxysilane, the mixture solution reacts for about 3 hours. In the reaction process, the mixture solution is agitated by a magnetic stirrer. After the reaction process, the mixture solution becomes into a sol solution, the sol solution is formed is stood for 15 hours to make the sol solution age, as a result, a $SiO_2$ gel solution is formed with a full hydrolyzation and polymerization.

The $SiO_2$ gel solution may be regarded as coating solution for forming film, and in general, the mixture of the $SiO_2$ gel solution and the ethanol according to weight ratio which may be 1:0.5, 1:1, 1:2, 1:3, 1:4 or 1:5 is used to form film of different thickness.

When the $SiO_2$ gel solution as the coating solution is used, coat the $SiO_2$ gel solution on a substrate evenly, and heat the coating solution by a fixed heat source to make the coating solution dry to form a film. Then, measure the thickness of the film by a scanning electron microscope, the thickness of the film is 57 micron.

When the mixture of the $SiO_2$ gel solution and the ethanol according to the weight ratio 1:0.5 is used to as coating solution, firstly, mix 200 g $SiO_2$ gel solution with 100 g ethanol (as diluent) to form the coating solution, the concentration of the coating solution is 66.7%. Then, coat the coating solution on a substrate evenly, and heat the coating solution by a fixed heat source to make the coating solution dry to form a film. Next, measure the thickness of the film by a scanning electron microscope, the thickness of the film is 22 micron.

When the mixture of the $SiO_2$ gel solution and the ethanol according to the weight ratio 1:1 is used to as coating solution, mix 200 g $SiO_2$ gel solution with 200 g ethanol (as diluent) to form the coating solution, the concentration of the coating solution is 50%. After the same steps above, the thickness of the film is 17 micron.

When the mixture of the $SiO_2$ gel solution and the ethanol according to the weight ratio 1:2 is used to as coating solution, mix 200 g $SiO_2$ gel solution with 400 g ethanol (as diluent) to form the coating solution, the concentration of the coating solution is 33.3%. After above steps the thickness of the film is 7 micron.

When the mixture of the $SiO_2$ gel solution and the ethanol according to the weight ratio 1:3 is used to as coating solution, mix 200 g $SiO_2$ gel solution with 600 g ethanol (as diluent) to form the coating solution, the concentration of the coating solution is 25%. After the same steps above, the thickness of the film is 4 micron.

When the mixture of the $SiO_2$ gel solution and the ethanol according to the weight ratio 1:4 is used to as coating solution, mix 200 g $SiO_2$ gel solution with 800 g ethanol (as diluent) to form the coating solution, the concentration of the coating solution is 20%. After the same steps above, the thickness of the film is 2 micron.

When the mixture of the $SiO_2$ gel solution and the ethanol according to the weight ratio 1:5 is used to as coating solution, mix 200 g $SiO_2$ gel solution with 1000 g ethanol (as diluent) to form the coating solution, the concentration of the coating solution is 16.7%. After the same steps above, the thickness of the film is 1.5 micron.

As shown in FIG. 1, a schematic diagram showing the relation of the thickness of the film and the ratio of the $SiO_2$ gel solution in the coating solution is made according to the data mentioned above, the thickness of the film and the ratio of the $SiO_2$ gel solution to the coating solution is a quadratic function parabola relation. Therefore, a film with a predetermined thickness can be made through adjusting the ratio of the $SiO_2$ gel solution in the coating solution according to the schematic diagram in FIG. 1.

Thus, the method for forming the film on the substrate can adjust the thickness of the film in the manufacturing process. The present invention adds a step of mixing the gel solution with the diluent in the traditional sol-gel technology, in order to make the thickness of the film vary along with the ratio of the gel solution in the coating solution for controlling the thickness of the film. The method for forming the film on the substrate suits to the film which can be made by sol-gel technology, such as $SiO_2$ film, $TiO_2$ film, $ZrO_2$ film, etc, therefore, the method for forming the film on the substrate has a simply process and can be performed in the normal temperature, and the thickness of the film can be controlled exactly, so the method can be used in industry field.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A method for forming a film on a substrate, comprising steps of:

(1) blending precursor, solvent, de-ionized water and catalyst to form sol solution;

(2) standing the sol solution for a period of time to form gel solution;

(3) mixing the gel solution with diluent in proportion between 1:0.5 to 1:5 to form coating solution; and (4) coating the coating solution onto the substrate and then drying the coating solution to form a film between 22 micron to 1.5 micron on the substrate;

wherein the mixture of the gel solution and the diluent in proportion between 1:0.5 to 1:5 is used to form the film of different thickness between 22 micron to 1.5 micron; and wherein the mixture of the gel solution and the diluent in proportion 1:0.5 is used to form the film of thickness 22 micron; the mixture of the gel solution and the diluent in proportion 1:1 is used to form the film of thickness 17 micron; the mixture of the gel solution and the diluent in proportion 1:2 is used to form the film of thickness 7 micron;

the mixture of the gel solution and the diluent in proportion 1:3 is used to form the film of thickness 4 micron; the mixture of the gel solution and the diluent in proportion 1:4 is used to form the film of thickness 2 micron; the mixture of the gel solution and the diluent in proportion 1:5 is used to form the film of thickness 1.5 micron.

2. The method as set forth in claim 1, wherein the precursor is selected from silane compounds which are expressed in a chemical formula, the formula being $R_nSiX_{4-n}$, wherein R means an organic functional group, X means a hydrolytic functional group, and n equals to zero, one or two.

3. The method as set forth in claim 1, wherein the precursor is selected from the group consisting of tetraethoxysilane, tetramethyl orthosilane, methyl triethoxy silane and ethyl triethoxy silane.

4. The method as set forth in claim 1, wherein the diluent is selected from the group consisting of methanol, ethanol and isopropanol.

5. The method as set forth in claim 1, wherein the solvent is selected from the group consisting of methanol, ethanol or isopropanol.

6. The method as set forth in claim 1, wherein the sol solution is stood for 12-24 hours.

7. The method as set forth in claim 1, wherein the catalyst is HCl solution.

8. The method as set forth in claim 7, wherein the precursor is tetraethoxysilane, the solvent is ethanol, the weight ratio of the tetraethoxysilane, the ethanol, the de-ionized water and the HC1 solution is 20:25:3:2 before the diluent is added.

9. The method as set forth in claim 8, wherein the tetraethoxysilane, the ethanol, the de-ionized water and the HC1 solution is blending for 2-4 hours to reaction in acid condition.

10. The method as set forth in claim 9, wherein the pH value of the acid condition is 3.9-4.0.

* * * * *